United States Patent [19]

Testa

[11] 3,994,441

[45] Nov. 30, 1976

[54] SPRINKLER ADAPTED FOR ATTACHMENT TO THE GROUND

[75] Inventor: Joseph E. Testa, Woodcliff Lake, N.J.

[73] Assignee: Beatrice Foods Co., Moonachie, N.J.

[22] Filed: July 25, 1975

[21] Appl. No.: 598,759

Related U.S. Application Data

[63] Continuation-in-part of Ser. No. 585,818, June 11, 1975, abandoned.

[52] U.S. Cl. ..... 239/276; 138/106; 248/87

[51] Int. Cl.² ..... B05B 15/06

[58] Field of Search ..... 239/271, 273, 275, 276, 239/279, 280; 248/49, 85, 87, 88; 138/106, 108, 110

[56] References Cited

UNITED STATES PATENTS

| | | | |
|---|---|---|---|
| 1,743,537 | 1/1930 | Freese | 239/276 X |
| 2,421,103 | 5/1947 | Wadsworth | 239/276 X |
| 2,721,764 | 10/1955 | Wilson, Jr. | 239/276 |
| 2,852,307 | 9/1958 | Clark | 239/276 |

*Primary Examiner*—Johnny D. Cherry
*Assistant Examiner*—Andres Kashnikow

[57] ABSTRACT

A sprinkler comprises a nozzle attached at one end of an elongated member, an earth-penetrating element attached at the other end of the member, and a foot-step. The nozzle is attached to a passage in the elongated member through a fluid communication means and receives fluid transmitted to it through the passage from a fluid source. The element is attached to the member by two element portions receiving a section at one end of the member therebetween and interengaging parts, such as a projection - recess combination, on each of the element portions and the member section. Adjacent to each member interengaging part is a groove running between, and bounded by the element portions. The foot-step is secured by securing it to those parts of the element portions bounding the groove, with the securing means being received within the groove.

12 Claims, 4 Drawing Figures

SPRINKLER ADAPTED FOR ATTACHMENT TO THE GROUND

This application is a continuation-in-part of U.S. Ser. No. 585,818, filed June 11, 1975 now abandoned.

The present invention relates to a sprinkler and, in particular, to one that is adapted to be secured to the ground.

Three basic types of sprinklers are now generally available. One type is stationary and sits low on the ground. Another type is mobile and travels automatically as it sprinkles, and a third, also stationary, has its nozzle elevated to a given height from the ground. Each is designed to accommodate a particular need. The third type, which is the one to which this invention is directed, is often used when the height of the nozzle is of particular advantage. For example, the size of the sprinkled area is dependent on the distance of the nozzle from the ground. Thus, given a particular water pressure, a greater area is sprinkled when the height of the nozzle is increased. In addition, such a unit may be required to reach an elevated place or to sprinkle the leaves of high-standing shrubs, flowers, or vegetable garden plants. In order to prevent its being tipped over easily, the base support of such a tall unit must either be relatively wide or it must be firmly fastened to something stationary and stable. Resort to a large base results in greater weight, bulk and cost. Since weight and bulk limit portability and storageability, respectively, and since a minimization of cost is sought, such an approach is preferably avoided. Consequently, the tendency has been to insert the slender lower portion of the sprinkler unit into the ground. This provides the requisite stability combined with compactness and light weight since the unit need only comprise an elongated part, such as a tube, containing a fluid passage and carrying a nozzle at one end and an earth-penetrating member, such as a spike, at its other end.

The main problem with such a unit concerns the attachment between the spike and the tube. If a hole is drilled in the tube to accommodate an attachment means for securing the spike to it, the structural integrity of the tube is compromised and/or water may wastefully leak through the hole, decreasing the effectiveness of the sprinkler which is thereby sprinkling less water over a smaller area. If the attachment is made without such a hole in the tube, it tends to loosen with usage and eventually the spike breaks away from the tube. Similar attachment problems arise regarding a foot-step which is secured to the unit to facilitate its being driven into the ground.

Accordingly, it is the prime object of the present invention to provide a secure, rigid, and reliable attachment for securing a spike to a fluid-carrying tube in a sprinkler unit without the necessity for drilling holes in the tube.

Another object of the present invention is to provide an attachment means for securing a spike to a tube in a sprinkler unit that is simple, effective, and inexpensive.

A further object of the present invention is to provide a sprinkler adapted to be secured to the ground and having a foot-step reliably and securely attached without the need for drilling any holes in the fluid-carrying member of the sprinkler.

In accordance with these objects, a sprinkler is provided comprised of a nozzle, an elongated member, an earth-penetrating element, and a foot-step. The nozzle is attached to one end of the member and is in fluid communication with a fluid passage along the member. The earth-penetrating element is attached to a section at the other end of the member. The means for attaching the element to the member is comprised of two element portions receiving the member therebetween and interengaging parts, such as a projection-recess combination on each of the element portions and the member. The snugness of the fit of a projection within a recess provides a strong, rigid and reliable attachment without any need for drilling holes in the member.

Adjacent to each member depression is a groove running between and bounded by the element portions. This groove serves a dual purpose in that, first, it reinforces the member to prevent any undesirable deformations in the member as the depressions are formed. Second, the means for securing the foot-step to the element are received in the groove and connected between those parts of the element portions bounding the groove. Without such a groove, the element portions would have to be larger to be connectible to the securing means, thereby increasing the cost of the unit.

To the accomplishment of the above and to such other objects as may hereinafter appear, the present invention relates to the construction of a sprinkler, as defined in the appended claims and as described in this specification, taken together with the accompanying drawings, in which:

Figure 1:
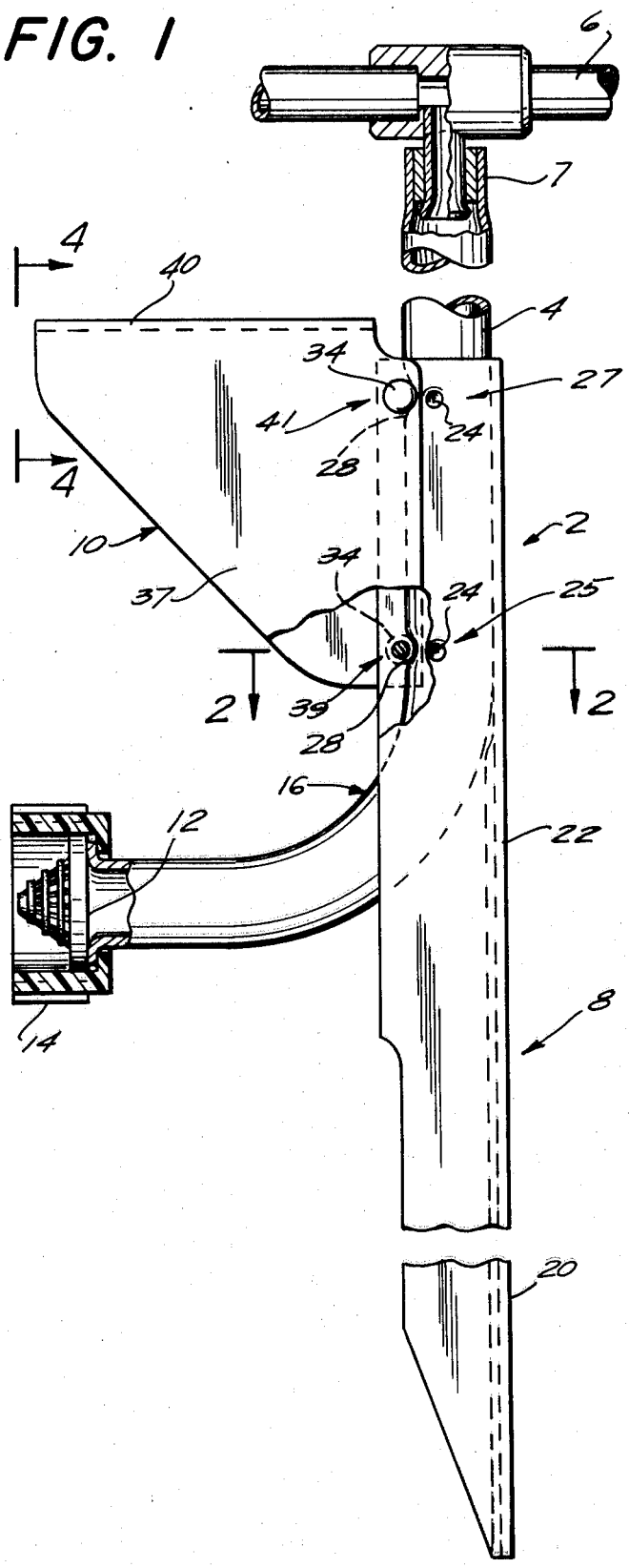
FIG. 1 is a fragmentary side view showing the sprinkler of the present invention.
Figure 4:
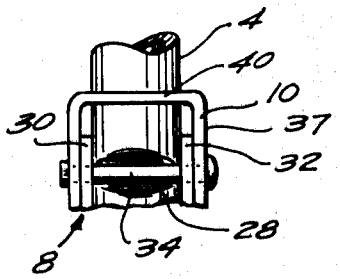
FIG. 4 is a fragmentary front elevation view taken along line 4—4 in FIG. 1.

A significant problem with attaching an earth-penetrating element to a fluid-carrying member in a sprinkler has been providing a secure, rigid and reliable attachment without the need for drilling any holes in the member. This problem is solved by the present invention. Specifically, FIG. 1 shows a sprinkler unit 2 comprised of a tube 4, a nozzle 6, an earth-penetrating member 8 and a foot-step 10. Tube 4 has nozzle 6 attached to one end in a well-known manner through a fluid communication means 7, and an orifice 12 at its other end. A conventional hose socket 14 is attached to tube 4 at orifice 12 to accommodate a garden hose (not shown) for conveying water from a fluid source (not shown) to the sprinkler. A detailed description of nozzle 6, its attachment to tube 4, and socket 14 is deemed unnecessary since these form no part of the invention and are of a conventional nature.

Lower end 16 of tube 4 containing orifice 12 is bent at an angle to the remainder of tube 4. End portion 16 is designed to be substantially parallel to the ground in the operating position of sprinkler 2 to facilitate the connection of a garden hose (not shown) to sprinkler 2 whereas tube 4 is designed to be perpendicular to and extend away from the ground. Earth-penetrating element 8, comprised of a spike portion 20 and a channeled portion 22, is attached to the lower end of tube 4 and forms an effective linear extension of it. Thus, when spike 20 is inserted into the ground, nozzle 6 is at a height from the ground determined primarily by the height of tube 4.

Figure 3:
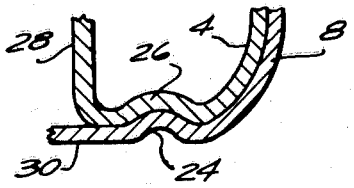
FIG. 3 is an enlarged view of the portion of FIG. 2 showing the projection-recess attachment.
Figure 2:
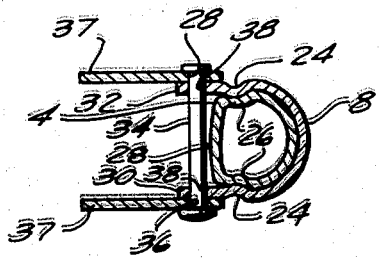
FIG. 2 is a cross-sectional view taken along line 2—2 of FIG. 1.

Lower end portion 16 of tube 4 is received within channel 22 of earth-penetrating element 8. As best shown in FIG. 2, tube 4 fits snugly within channel 22 so that only movement along the axis of tube 4 or toward the open side of channel 22 is possible. In order to prevent such movement of tube 4, corresponding portions of channel 22 and tube portion 18 are provided with a projection-recess combination with the projection fitting snugly within the recess to form an attachment. In the preferred embodiment, a projection 24 on element 8 fits within a recess 26 on tube 4, as best seen in FIG. 3. When such a combination is provided on opposite sides of tube 4, it can be removed from channel 22 only with considerable force. The sturdiest attachment is provided by forming projections 24 and recesses 26 simultaneously by forcing a tool against sidewalls 30 and 32 of channel 22 after portion 16 has been appropriately positioned in element 8. This operation, known as dimpling, forms a tight fit between the projections and recesses not possible with other methods and does so at a relatively low cost. However, if only one set of these is provided on opposite sides of tube 4, such as at attachment point 25, the attachment would eventually be loosened because the portion of tube 4 within channel 22 but spaced from the attachment point would be free to vibrate in a direction toward the open side of the channel. Consequently, another attachment point 27, spaced longitudinally from the first attachment point, is provided to form a rigid attachment. Thus, it should be clear that the lower end 16 of tube 4 is firmly supported by U-shaped channel 22 from three directions with walls 30 and 32 firmly engaging tube 4 while the attachment is provided by four projections 24 cooperating with four recesses 26. This arrangement provides a strong, rigid and reliable attachment between earth-penetrating element 8 and tube 4. Use of a strong material for earth-penetrating member 8 and tube 4, and an increase in the depth of the projections and recesses, are both factors adding to the rigidity and reliability of the attachment.

As best seen in FIGS. 1 and 2, tube 4 has grooves 28 running laterally between channel sidewalls 30 and 32 and corresponding recesses 26. The placement of grooves 28 adjacent recesses 26 is significant since this tends to reinforce tube 4 in the area of recesses 26 so that as the latter are formed, no undesirable deformations restricting the fluid passage and weakening the structure are formed. In addition to this function, grooves 28 receive rivets 34 which attach foot-step 10 to channel sidewalls 30 and 32 of element 8. As best seen in FIG. 2, holes 36 in sidewalls 37 of foot-step 10 are aligned with holes 38 in channel sidewalls 30 and 32, and rivet 34 is then inserted through the aligned holes 36 and 38 and riveted in place. It should be clear that in the absence of groove 28, channel sidewalls 30 and 32 would have to be widened so that rivet 34 could extend between them without passing through tube 4. Thus, the groove 28 decreases the size required for sidewalls 30 to thereby decrease the size, weight and cost of sprinkler unit 2.

Foot-step 10 is attached to earth-penetrating element 8 at locations 39 and 41. This increases the strength of the attachment as well as prevents rotation of foot-step 10 with relation to element 8 if only one rivet were used. Foot-step 10 is comprised of a flat portion 40 connecting the tops of sidewalls 37 and designed to accommodate a foot as spike 20 is driven into the ground. Foot pressure on portion 40 results in insertion of spike 20 into the ground.

The cost of sprinkler 2 can be kept low by using a sturdy yet inexpensive material such as sheet metal. Parts 4, 8 and 10 of sprinkler 2 lend themselves to being formed of sheet metal by any conventional method, such as stamping. Such a method, as well as the dimpling operation, requires little labor and time and thus the unit cost is relatively low. The combination of inexpensive yet sturdy materials and low cost but reliable manufacturing methods results in an economically priced sprinkler and provides long and satisfactory service.

It will be apparent from the foregoing that the advantages of the present invention are achieved by attaching an earth-penetrating element to a fluid-passage-containing member by forming projection-recess combinations in each, respectively, which cooperate with each other to form a strong, rigid and reliable attachment without the need for holes in the fluid-carrying member. The member is reinforced by forming grooves adjacent the attachment points to prevent formation of undesirable deformations and the grooves serve to receive the securing means for securing a foot-step to the element to thereby reduce the requisite size of the element.

While but a single embodiment of the present invention has been here specifically disclosed, it will be apparent that many variations may be made therein, all within the scope of the instant invention as defined in the following claims:

I claim:

1. A sprinkler adapted to be secured to the ground comprising: an elongated member having a passage therealong, a nozzle attached to said member adjacent the upper end of said passage, fluid communication means connected between said nozzle and said passage, and an earth-penetrating element having two portions engaging said member therebetween adjacent the lower end of said member, said member being provided with a longitudinally spaced plurality of pairs of opposing recesses and with a groove extending substantially from one element portion toward the other adjacent each of said recess pairs, and said element portions being provided with a longitudinally spaced corresponding plurality of pairs of opposing projections engaging said recesses to thereby rigidly secure said earth-penetrating element to said member.

2. The sprinkler of claim 1 additionally including connection means adjacent the lower end of said member in fluid communication with said member passage, extending out from said member proper from a point between said element portions, and adapted for operative connection with an external fluid source.

3. The sprinkler of claim 2, in which the lowermost integral part of said member extends out laterally from said member proper and said connection means is located on said lowermost integral part.

4. The sprinkler of claim 3, in which said member is a tube and said element portions define part of a substantially U-shape cross-sectional section within which a part of said member is secured.

5. The sprinkler of claim 2, in which said member is a tube and said element portions define part of a substantially U-shape cross-sectional section within which a part of said member is secured.

6. The sprinkler of claim 1, in which said member is a tube and said element portions define part of a substantially U-shape cross-sectional section within which a part of said member is secured.

7. In the sprinkler of claim 1, a step extending laterally out from said element adjacent the upper end thereof and having an upper exposed surface upon which one can step to drive the earth-penetrating element into the ground, and attachment means secured between said element portions engaging said step and received in said groove for attaching said step to said element.

8. The sprinkler of claim 7, in which said element and said step are formed of sheet metal.

9. In the sprinkler of claim 1, a step extending laterally out from said element adjacent the upper end thereof and having an upper exposed surface upon which one can step to drive the earth-penetrating element into the ground, and means for securing said step to said element.

10. The sprinkler of claim 9, in which said element and said step are formed of sheet metal.

11. The sprinkler of claim 1, wherein said member is a tube having one end received between said element portions.

12. The sprinkler of claim 1, wherein said member is a sheet metal tube and said element is formed of sheet metal.

* * * * *